US008528571B2

(12) United States Patent
Costa

(10) Patent No.: US 8,528,571 B2
(45) Date of Patent: Sep. 10, 2013

(54) HAIR EXTENSION ASSEMBLY AND METHOD OF APPLICATION

(76) Inventor: Maria Evania Araujo Costa, Boca Raton, FL (US)

( * ) Notice: Subject to any disclaimer, the term of this patent is extended or adjusted under 35 U.S.C. 154(b) by 245 days.

(21) Appl. No.: 12/901,175

(22) Filed: Oct. 8, 2010

(65) Prior Publication Data

US 2012/0085362 A1 Apr. 12, 2012

(51) Int. Cl.
*A41G 5/00* (2006.01)

(52) U.S. Cl.
USPC ..... 132/201; 132/53

(58) Field of Classification Search
USPC ..... 132/201, 53–56
See application file for complete search history.

(56) References Cited

U.S. PATENT DOCUMENTS

| | | | | |
|---|---|---|---|---|
| 2,233,100 | A * | 2/1941 | Jevnikar | 132/53 |
| 5,313,963 | A * | 5/1994 | Rennex | 132/54 |
| 2006/0086368 | A1* | 4/2006 | Salinas | 132/201 |
| 2008/0276949 | A1* | 11/2008 | Lee | 132/53 |

* cited by examiner

*Primary Examiner* — Rachel Steitz
(74) *Attorney, Agent, or Firm* — Malloy & Malloy, P.L.

(57) ABSTRACT

A hair extension assembly includes an elongated base being sufficiently flexible to conform to the contours of the wearer's head and including an attachment assembly comprising a plurality of loops extending along one longitudinal side of the base. A collection of extension hair includes a plurality of supplemental strands secured to the base substantially opposite relative to the plurality of loops. As applied, the base and more specifically the plurality of loops are disposed in adjacent, substantially aligned relation to a hair part or seam formed in the natural hair of the wearer. A plurality of natural hair groupings are formed along one side of the seam and the plurality of loops are cooperatively disposed and dimensioned to facilitate passage of the hair groupings therethrough for attachment to one another thereby securing the base and the collection of extension hair in an intended position on the head of the wearer.

7 Claims, 5 Drawing Sheets

HAIR EXTENSION ASSEMBLY AND METHOD OF APPLICATION

BACKGROUND OF THE INVENTION

1. Field of the Invention

This invention is directed to a hair extension assembly and a method of securing it to the natural scalp hair of a wearer. An attachment assembly is connected to a base and cooperatively structured therewith to facilitate passage of a plurality of natural hair groupings there through. The natural hair groupings are secured to one another subsequent to passage through the attachment assembly thereby accomplishing a secure, long lasting application in a manner which avoids the disadvantages of attaching it to the wearer's head in a conventional manner.

2. Description of the Related Art

There are many and various techniques and products designed to increase hair volume and/or hair length. Chemical products or the addition of natural or artificial hair to the natural scalp hair are well known. The hair pieces vary in structure, design and materials, as well as the methods of application to the natural hair of the wearer. The disadvantages and problems associated with such known devices are well known and the satisfaction level of wearers is generally low. However, people continue to use such known devices as well as the current techniques of application, due in large part to the unavailability of viable alternatives.

Aside from inferior extension designs and techniques of attachment, there are also drawbacks associated with the adhesive products that are used to attach the extension hair to the natural scalp hair. More specifically, as commonly applied the adhesive becomes brittle, and therefore allows hair loss of the extension hair as well as damage to the natural hair. Removal of the adhesive is time consuming, and further damages the hair. In addition, the glue does not have a long operable life thereby requiring the extension hair to be replaced often, further damaging the natural hair.

Moreover, current application techniques, with the exception of "comb style" extensions, take several hours, and therefore reduce profitability of the stylist and tolerance of the client. Some of the current techniques used for the application of hair extensions include the relatively small gatherings of extension hair being bonded to the natural scalp hair. It is recognized that this procedure may take one or even two days, resulting in very high costs to the client. Also, the ability to naturally comb, brush and even wash known extension hair is limited. From an appearance stand point, the attached hair is placed under the top layer of natural hair in a manner which still renders it visible during normal daily activities.

Other known extension structures and methods of application include the use of small tubes through which extension hair and natural head hair are threaded. The tubes are then clamped to grip the hair contained therein. As with other known techniques, the use of such tubes, etc. is uncomfortable and easily observable. Other techniques include the use of small beads to tie the extension hair to the natural head hair. In addition, combs and clasps are frequently used but are recognized as being temporary, uncomfortable to wear, and easily detectable. Another method includes weaves and braiding of natural and extension hair. However, these methods are very time consuming for original applications and must be completely removed and re-applied to accommodate hair growth. Still other known techniques may utilize plastics and tape adhesives to attach extension hair strips to the wearer's scalp or hair. Recognized problems include the formation of "lumps" or "bulges" under a top layer of natural hair.

Use of at least some of these known techniques also causes damage to the natural scalp hair in addition to the long application time and high costs to the user, as set forth above. As also indicated, most current hair extension products and techniques must be completely removed and reapplied to overcome deterioration of the extension hair and the growth of the wearer's natural hair. Finally, known techniques for applying extension hair involve extensive training and a long learning curve for the stylist in order to become proficient in the application method and to provide the user with a desired and consistent appearance.

SUMMARY OF THE INVENTION

The present invention is directed to a hair extension assembly as well as a method of its application to the scalp hair of the wearer. Accordingly, the structural and operative features of the hair extension assembly provide for an increase in hair volume and/or hair length of the wearer's natural hair. Moreover, the method of attaching the hair extension to the hair of the wearer can be learned by a hair stylist in a significantly shortened training period. Advantageously, when applied to the hair of the wearer, the hair extension can be washed and subjected to conventional, every day treatment.

More specifically, the various preferred embodiments of the hair extension assembly of the present invention include an elongated base formed of an appropriate material such as, but not limited to, an open mesh material. As will be apparent, the material used for at least the base has sufficient flexibility to conform to the natural contours of the wearer's head and/or scalp. The base further includes a collection of extension hair comprising a plurality of supplemental strands connected to the base and extending outwardly preferably from a common longitudinal side thereof. Different ones of the hair extension assembly of the present invention may include the plurality of supplemental strands varying in number, length, texture, color, etc. and be collectively formed from a variety of different materials including, but not limited to human hair or other hair-like substitutes known in the industry.

In addition, the base includes an attachment assembly secured to and extending along at least a majority of the length of one longitudinal side of the base which is opposite to the side associated with the plurality of supplemental strands, as set forth above. Moreover, the attachment assembly is structured to facilitate the passage of the natural hair of the wearer therethrough in a manner which secures the base and the remainder of the hair extension assembly to the head of the wearer in an efficient and effective manner. At least one or more preferred embodiments of the attachment assembly comprise a plurality of loops collectively extending along the length of the common longitudinal side of the base. As such, the plurality of loops may be integrally formed with the base or otherwise connected thereto so as to at least partially define the longitudinal side of the base which is common to the plurality loops.

Further, the plurality of loops may be disposed in a contiguous or spaced apart relation to one another and are sufficiently dimensioned and configured to facilitate the passage of natural hair of the wearer through correspondingly disposed ones of the plurality of loops. As set forth in greater detail hereinafter, the effective application of the hair extension assembly to the head of the wearer is accomplished by forming a plurality of hair groupings from the natural hair of the wearer. The plurality of natural hair groupings are formed to collectively extend along a length of and adjacent to a "hair part" or seam. Such a seam will be formed in a predetermined location and in a horizontal or transverse orientation across the head of the wearer. As such, the plurality of natural hair groupings are formed from the natural hair of the wearer located adjacent the formed seam or hair part.

Further steps in the application of the hair extension assembly to the head of the wearer include the positioning of the base and more specifically the plurality of loops defining the attachment assembly in adjacent and/or aligned relation to the seam or hair part. When the attachment assembly is in the preferred, aligned orientation, the plurality of natural hair groupings are manipulated, using appropriate hair styling instruments, so that they pass through correspondingly positioned ones of the plurality of loops. Thereafter, portions of the lengths of adjacent ones of the hair groupings are connected to one another, subsequent to having passed through the correspondingly disposed plurality of loops. At least two, but in certain embodiments a plurality of at least three, adjacently disposed natural hair groupings are secured to one another such as by using a wax based adhesive such as, but not limited to, Keratin. Alternatively, the free ends of two or more of the natural hair groupings, once having passed through the corresponding loops, may be secured to one another by a braiding technique or a tie method, each of which is commonly practiced by a number of hair stylists.

As should be apparent, more than one hair extension assembly may be applied to the head of the wearer at various levels in order to accomplish the intended enhancement of the length, thickness, etc. of the wearer's natural hair. However, in each instance, the base and attachment assembly is at least initially, adjustably connected in aligned relation to the seam or hair part. Such an adjustable connection facilitates a more accurate positioning of the attachment assembly relative to the seam, preferably along the length of the base and attachment assembly. Once attachment of the hair extension assembly is accomplished in the manner set forth in greater detail hereinafter, the supplemental strands of the collection of extension hair are then disposed in overlying relation to the seam and the natural hair of the wearer. As a result, the collection of extension hair and the natural hair of the wearer will be blended together to provide a natural appearance while accomplishing the intended purpose of increased volume, length, etc.

Further with regard to the method of attaching a hair extension assembly to the head of the wearer, the aforementioned seam or hair part is formed by gathering a collection of natural hair above the seam as well as a collection of natural hair being disposed below the seam or hair part. As set forth above, seam will preferably extend in a generally horizontal or transverse orientation to the wearer's head, assuming that the head is in a generally upright position. Hair clips or other conventional instruments may be used to obtain the collection of natural hair located above and/or below the seam. Upon application, the base of the hair extension is substantially aligned adjacent to the seam, wherein the plurality of loops associated with the connecting assembly are disposed above the seam but in substantially alignment therewith. Therefore, the plurality of loops are disposed in an "inverted" orientation such that the loops face downwardly toward the bottom or free end of the natural hair of the wearer. Clips or other conventional instruments may be used to secure the collection of extension hair, including the plurality of supplemental strands temporarily to the collection of natural hair located above the seam. Such clips or other conventional instruments thereby serve to removably dispose the base and the plurality of loops relative the seam further facilitating a more precise or accurate alignment of the loop with the seam.

Thereafter, the plurality of natural hair groupings are gathered by the hair stylists, wherein each grouping is disposed in somewhat spaced relation to the next adjacent natural hair groupings and each is sized to pass through a correspondingly disposed one of the plurality of loops. As such, not all of the plurality of loops will necessarily receive a natural hair grouping there through. However, the natural hair groupings while disposed in at least minimally spaced relation to one another will be sufficiently close or adjacent to facilitate the attachment of two or more adjacent hair groupings to one another subsequent to passing through correspondingly disposed loops of the attachment assembly. The connection of the hair extension assembly to the head of the wearer will thus be accomplished in a more 'natural' manner, thereby avoiding the discomfort, problems and recognized disadvantages of securing the portion of the hair extension directly to the head using adhesive or any other conventional manner.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying Figures, the present invention is directed to a hair extension assembly generally indicated as 10, which is structured to be added to the natural scalp hair 102 on the head of a wearer 100, as schematically represented in FIGS. 2-8. More specifically, the hair extension assembly 10 includes a base 12 formed of a mesh material or other material which includes a sufficient degree of flexibility to at least partially conform to the contours of the head and/or scalp of a wearer 100.

Figure 1A:
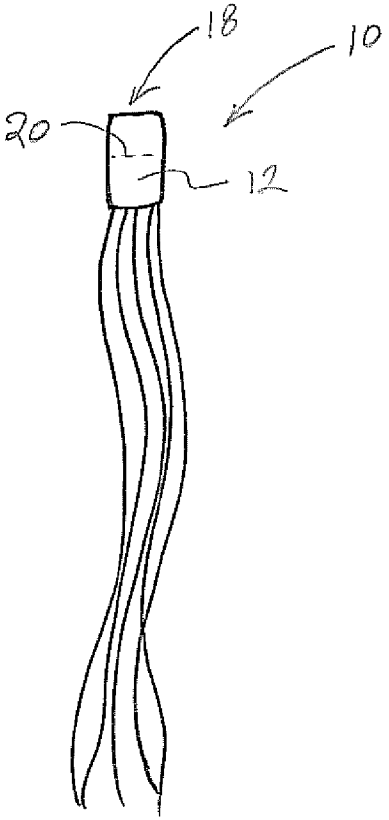
FIG. 1A is an end view of the embodiment of FIG. 1.
Figure 1:
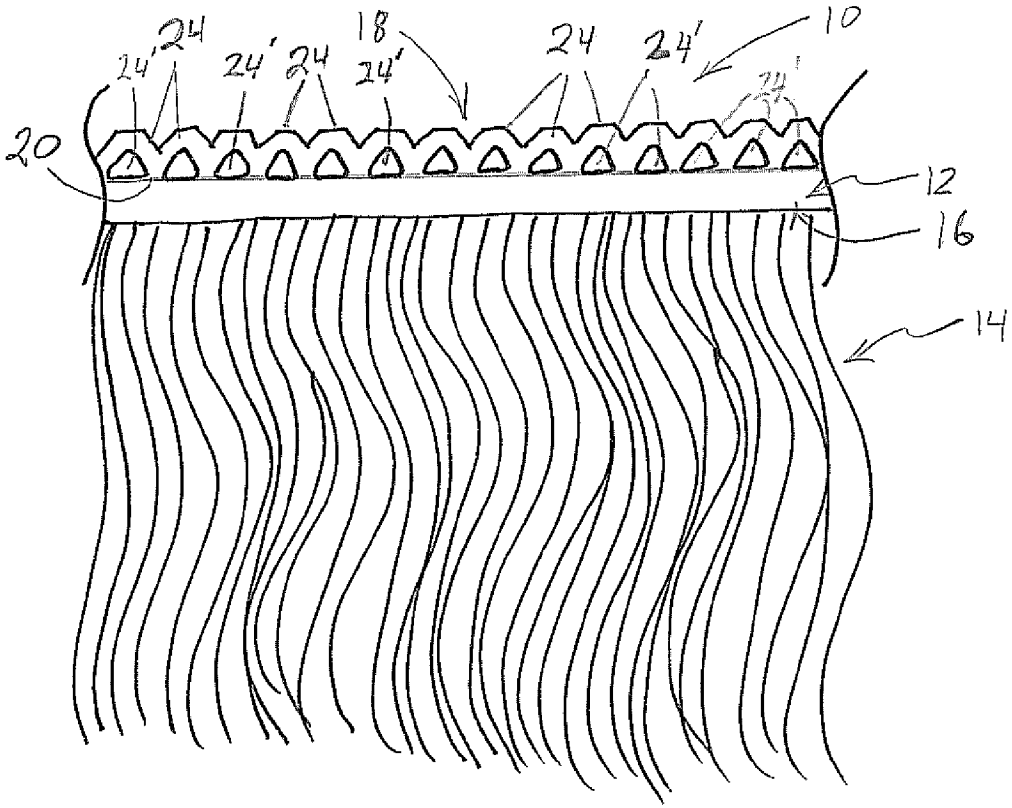
FIG. 1 is a front plan view in partial cutaway of the hair extension assembly of the present invention.
Figure 2:
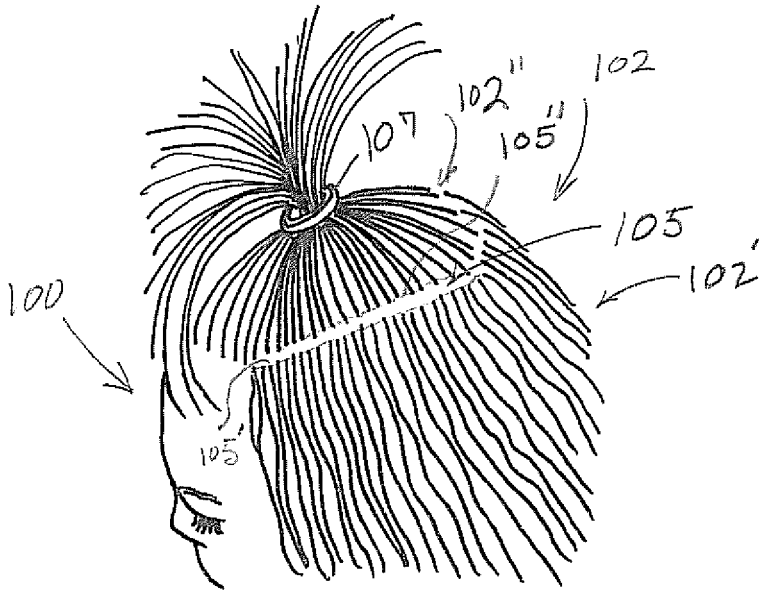
FIG. 2 is a perspective view of a user's head and scalp hair arranged to form a hair part or seam within a predetermined part of the natural hair of the wearer.

With primary reference to FIGS. 1 and 1A, the hair extension assembly 10 also includes a collection of extension hair comprising a plurality of supplemental strands generally indicated as 14. The supplemental strands may be formed of a variety of materials including human or animal hair or other material which may be commonly known to form wigs, hair pieces, etc. As such, the plurality of supplemental strands 14 may collectively or individually vary in length, texture, number, etc. dependent at least in part on the desires or intent of the wearer 100 to enhance the volume and/or length of the natural hair. Moreover, the plurality of supplemental strands 14 are connected to the base 12 such as by sewing thereto or by other appropriate means. As such, the plurality of supplemental strands 14 collectively extend along and outwardly from what may be generally considered a first longitudinal side 16 of the base 12.

As also represented in FIGS. 1 and 1A, the hair extension assembly 10 includes an attachment assembly generally indicated as 18 connected to or integrally formed along a second longitudinal side 20 of the base 12. As clearly represented in FIG. 1, the attachment assembly 18 may in fact define at least a portion of the second longitudinal side 20 and is oppositely disposed to the first longitudinal side 16 to which the plurality of supplemental strands 14 are attached. As also represented, the plurality of supplemental strands 14 and the attachment assembly 18 may extend along a majority or substantially the entire length of the corresponding longitudinal sides 16 and 20 and therefore along the corresponding length of the base 12.

The attachment assembly 18 is specifically structured to facilitate the attachment or connection of the hair extension assembly 10 to the natural hair 102 of the wearer 100, in a manner which avoids its repeated detachment and replacement due to normal hair growth. More specifically, the attachment assembly 18 is structured to facilitate the passage of predetermined portions of the natural hair or "hair groupings" 22 through the attachment assembly 18. The natural hair groupings 22 are subsequently interconnected in the manner described in detail with specific reference to FIGS. 1-7. Accordingly, at least one preferred embodiment of the hair extension assembly 10 defines the attachment assembly 18 as comprising a plurality of loops 24 each having an open interior 24' with a closed peripheral or boundary. Therefore, the plurality of loops 24 can be accurately described as being closed loops of sufficient dimension and configuration to facilitate the passage of the hair groupings 22 therethrough.

With further regard to FIG. 1, the plurality of closed loops 24 may be disposed in contiguous relation to one another or alternately in at least minimally spaced relation to one another. The plurality of loops 24 extend along a predetermined length of the base 12 and second longitudinal side 20. It is emphasized that the dimension and configuration of different ones of the hair extension assembly 10 may vary depending upon the needs and desires of the wearer 100. As set forth above, the number of supplemental strands 14 as well as the number of loops 24 may vary as they extend along a predetermined length of the corresponding first and second longitudinal sides 16 and 20. Therefore, the configuration and dimensions of different hair extension assemblies 10 may vary such as, but not limited to, when more than one hair extension assembly 10 is concurrently used by the same individual. When a plurality of hair extension assemblies 10 are applied to the natural hair 102 of the wearer 100, their placement will differ from one another so as to accomplish an enhancement of the length and/or volume of the natural hair, as desired by the wearer 100.

Figure 3:
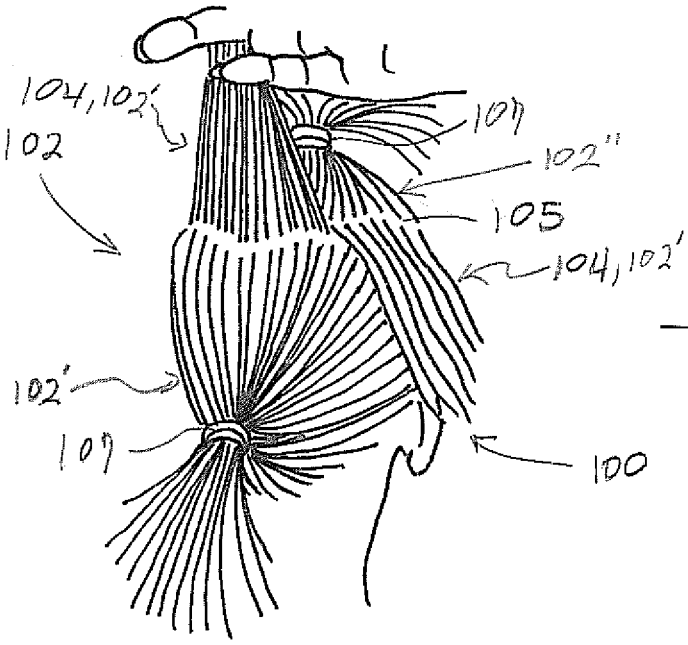
FIG. 3 is a rear perspective view of the embodiment of FIG. 2 wherein the hair part or seam is being formed.

As primarily demonstrated in FIGS. 2-8, the hair extension assembly 10 is structured to facilitate attachment or application thereof to the natural hair 102 of the wearer 100 in a manner which is distinguishable from known methods of attachment of conventional hair pieces. More specifically, in the attachment of each hair extension assembly 10, a "hair part" or seam 105 is formed in the natural hair 102 of the wearer 100 at a location where the extension assembly 10 is to be disposed. Moreover, the hair part or seam 105 is more specifically defined by a first collection of natural 102' located beneath the seam 105 and disposed to naturally extend downwardly from corresponding first side 105' schematically represented in FIG. 2. The hair part or seam 105 is further defined by a second collection of natural hair 102" positioned to extend upwardly or away from a second side 105" of the seam 105. As is also represented, in order to maintain the second collection of natural hair 102" on the corresponding side 105" of the seam 105, a clip, band, tie, etc. 107 may be used as indicated. Similarly, as represented in FIG. 3, a similar clip, band, tie, etc. 107 may be used to gather and/or maintain the first collection of hair 102' in a gathered orientation.

As also indicated, the hair part or seam 105 may be formed in a substantially horizontal orientation or more specifically an orientation which extends transversely across the hair 102 and head or scalp of the wearer 100. The term "horizontal" as used herein is not meant to describe a precisely horizontal orientation or position but rather describe the general disposition of the hair part or seam 105 when the head of the wearer 100 is maintained in a normal, upright position. In contrast, the term "vertical" may be used to describe the natural fall or hanging, of the first collection of natural hair 102' or orientation of the natural hair 102 before and after the hair extension assembly 10 is applied to the wearer 100.

Figure 4:
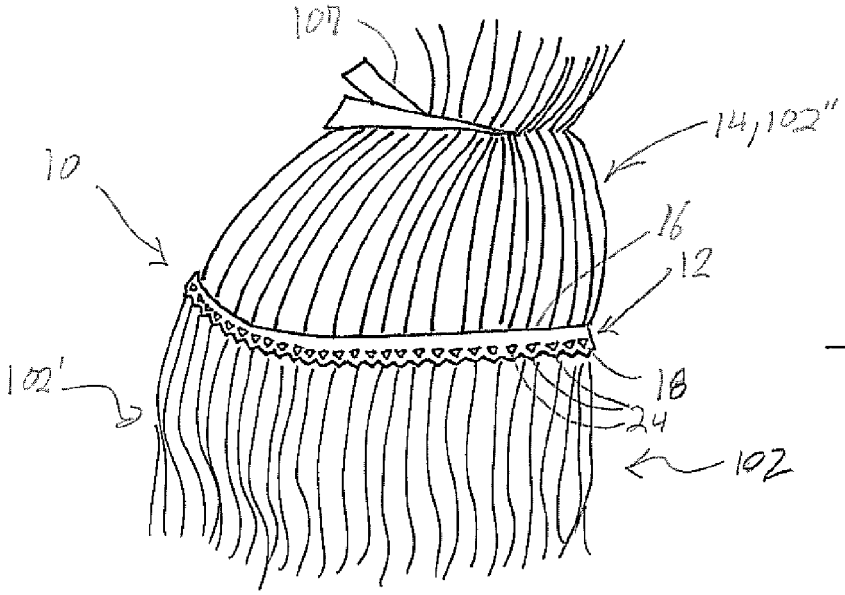
FIG. 4 is a perspective view of the hair extension assembly of the embodiment of FIGS. 1 and 1A being aligned with the formed hair part or seam of the embodiment of FIGS. 2 and 3.
Figure 5:
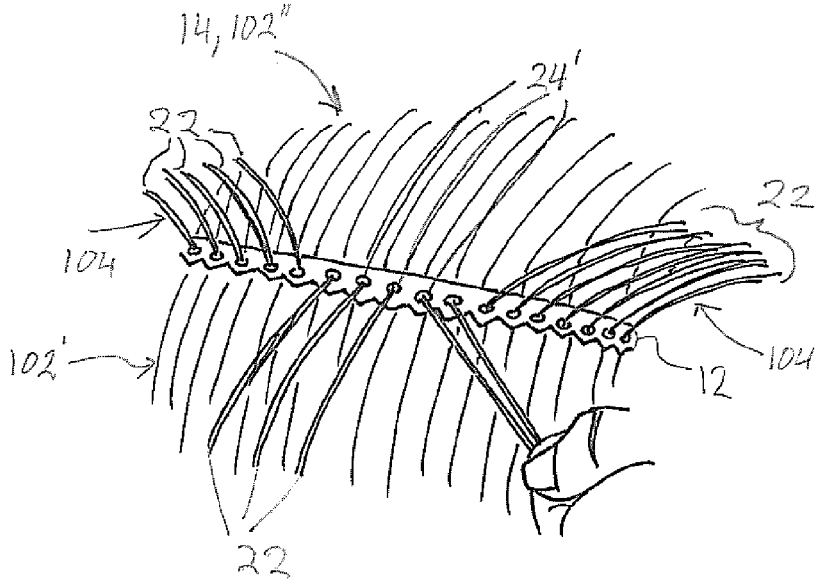
FIG. 5 is a perspective view in partial cutaway showing the various steps in the attachment of the hair extension assembly of the embodiment of FIGS. 1 and 1A to the natural hair of the wearer.
Figure 6:
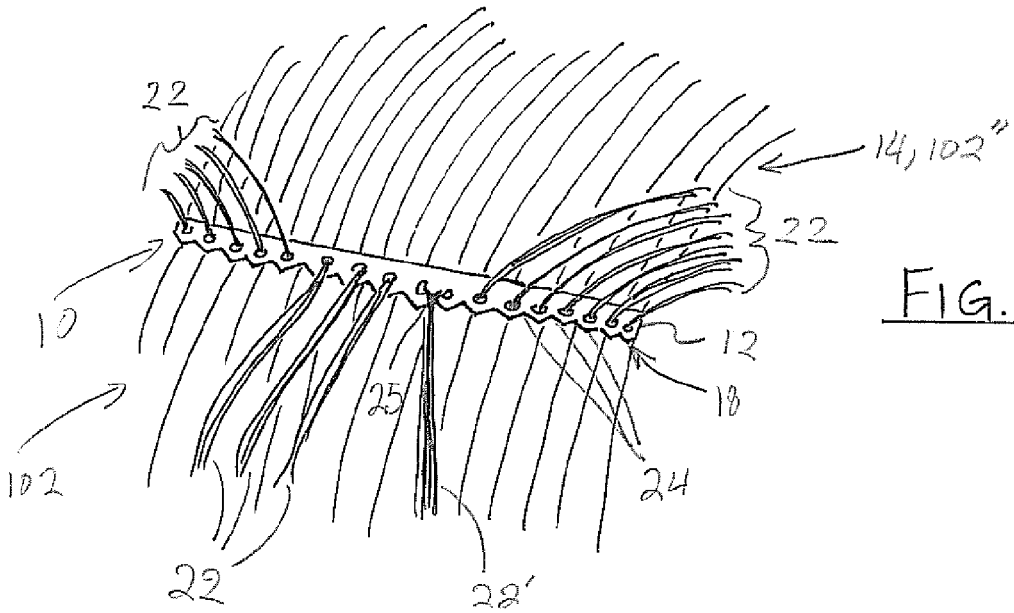
FIGS. 6 and 7 are each perspective views in partial cutaway further representing the method of applying the hair extension assembly of the embodiment of FIGS. 1 and 1A to the natural hair of the wearer.
Figure 7:
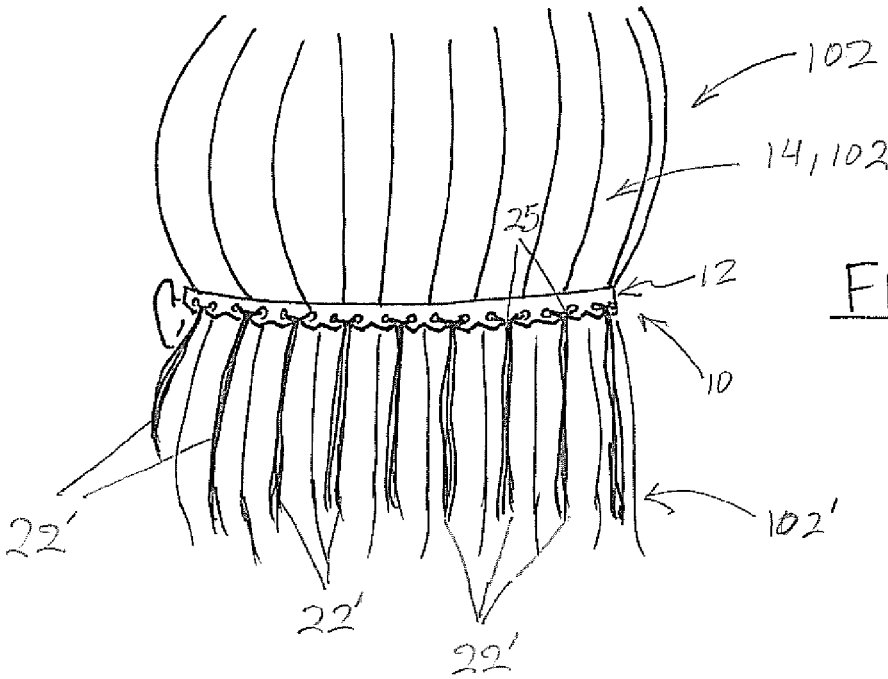

With primary reference to FIGS. 3-5, once the part or seam 105 has been formed and is clearly distinguishable on the scalp of the wearer 100 some of the hair, generally indicated as at 104 is separated from the first collection of natural hair 102'. The separated hair 104 is disposed adjacent to the first side 105' of the seam 105 and is sufficient in quantity to form a plurality of hair groupings 22, as set forth above and as represented in FIGS. 5-7. As also indicated, the plurality of hair groupings 22 comprise a plurality of natural hair strands, wherein each of the hair groupings 22 are disposed in spaced relation to one another on the same first side 105' of the seam 105 which defines the first collection of natural hair 102'. The plurality of hair groupings 22 may vary in number and the actual number of strands defining each hair grouping 22 may also vary in number. However, the number and size of the hair groupings 22 should be sufficient to facilitate a secure attachment of the base 12 to the natural hair 102 subsequent to the passage thereof through corresponding ones of the openings 24' of the closed loops 24. Also, the size of the natural hair groupings 22 should be at least partially dependent on the size and/or configuration of the loops 24 and openings 24'. By way of example only, one preferred embodiment of the attachment assembly 18 may include a dimension of the loops 24 to be in the range of ⅛ inch to ¼ inch in diameter, wherein the corresponding dimension of the openings 24' are slightly smaller.

The attachment of the hair extension assembly 10 is further represented in FIGS. 4 and 5, wherein the base 12 of the hair extension assembly 10 is adjustably and removably disposed in aligned relation with the seam 105. In the representations of FIGS. 4 and 5, the seam 105 is not clearly represented in that the alignment between the base 12 with the seam 105 may result in at least a portion of the base 12, such as the attachment assembly 18, being disposed in overlying relation to the seam 105. The adjustable alignment of the base 12 with the seam 105 is further defined by the plurality of closed loops 24, being disposed in an "inverted" orientation such that the plurality of loops 24 face downwardly along the length of the natural hair 102, 102'. In addition, the collection of extension hair defined by the plurality of supplemental strands 14 is removably connected to the second collection of natural hair 102" and maintained in overlying relation therewith by virtue of a clip, band, tie, etc. 107. The initial, adjustable attachment of the base 12 in adjacent relation to the seam 105 facilitates a more accurate or precise final alignment therewith. This initial adjustable alignment of the base 12 with the seam 105 facilitates the plurality of loops 24 being accurately disposed relative to the first collection of natural hair 102' and the plurality of hair groupings 22 formed therefrom, as clearly represented in FIGS. 5-7.

With primary reference to FIGS. 5 and 6, once the plurality of hair groupings 22 are formed so as to collectively extend along the first side 105' of the seam 105 they are individually passed through correspondingly disposed ones of openings 24' of the plurality of loops 24 defining the attachment assembly 18. FIGS. 5 and 6 represent each of the openings 24' of the closed loops 24 having a different hair grouping 22 passing there through. However, the present invention also contemplates that adjacent ones of the plurality of hair groupings 22 will be passed through spaced apart ones of the openings 24'. As a result, each of the openings 24' of the plurality of closed loops 24 may not have a hair grouping 22 pass therethrough. In addition, the manipulation of each of the plurality of hair groupings 22 which facilitates their passage through correspondingly disposed ones of the openings 24' may be accomplished by a hair stylist or other individual, utilizing appropriate instruments such as a "hair hook" commonly known in the hair styling industry.

As represented in FIGS. 6 and 7, once the plurality of hair groupings 22 have passed through correspondingly disposed openings 24', at least two of the adjacently positioned hair groupings 22 are connected together preferably by using a wax based adhesive such as Keratin. Alternatively, the adjacently disposed ones of the natural hair groupings 22 can be connected together such as by being braided or tied. However, when a wax based adhesive such as Keratin is used, heat may be applied to the adhesive to facilitate bonding of the at least two adjacent hair groupings 22. During such application of heat, appropriate plastic or other material shields may be used to protect the natural hair, scalp and supplemental hair strands of the wearer 100.

It should also be noted that more than two adjacently disposed hair groupings 22 may be secured together such as, but not limited to, at least three adjacently disposed hair groupings 22. Moreover, the location of the junction 25 of the connected or attached hair groupings 22' should be sufficiently close to the base 12 and the attachment assembly 18 to provide a tight, secure fitting of the base 12 adjacent to or aligned with the aforementioned hair part or seam 105. However, at least a minimal amount of spacing should be provided between the junction 25 of attached hair groupings 22' and the base 12 so as to allow a certain amount of flexibility and natural movement of the attached hair extension assembly 10 relative to the natural hair 102 of the wearer 100.

Figure 8:
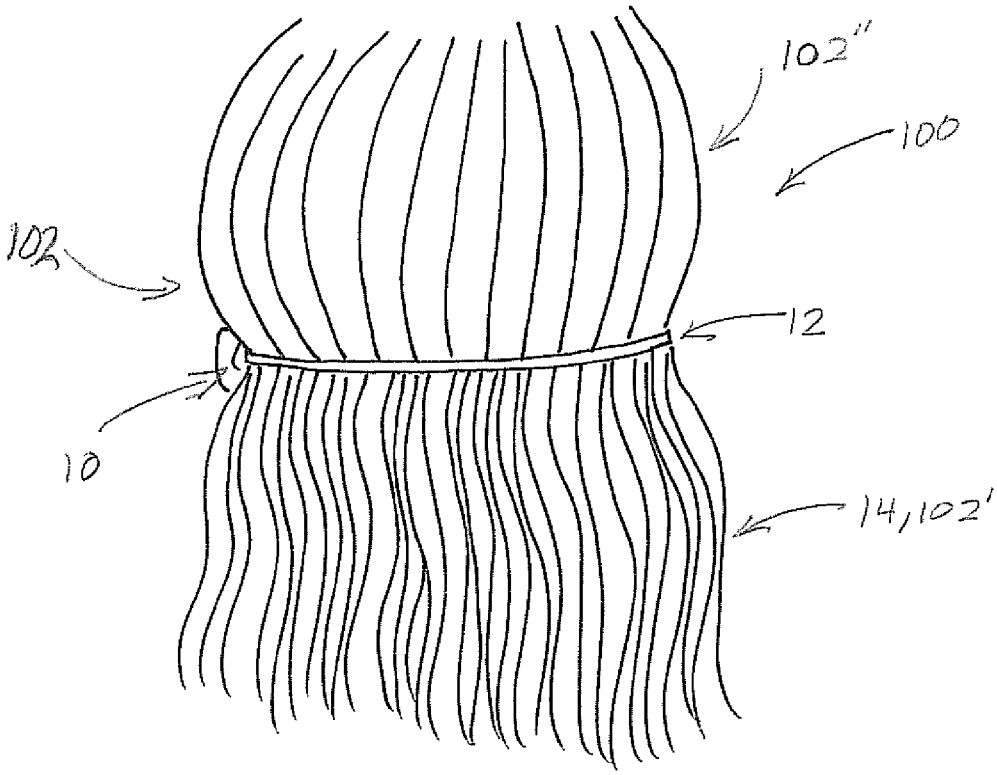
FIG. 8 is a perspective view in partial cutaway of a hair extension assembly of the embodiment of FIGS. 1 and 1A having been attached to the natural hair of a wearer and being blended therein.

FIG. 7 represents a plurality of adjacent hair groupings 22' being secured together at corresponding junctions 25 subsequent to having been passed through corresponding ones of the loops 24 and/or openings 24'. Prior to completing all of the connections of the hair groupings 22', the supplemental strands 14 defining the collection of extension hair will be maintained in overlying or otherwise connected relation to the second collection of natural hair 102" by the aforementioned clip, connector, band, tie, etc. 107. However, upon completion of the attachment of the hair groupings 22', the supplemental strands 14 will be detached from the second collection of natural hair 102" and folded over the base 12 and attachment assembly 18 so as to be blended with the first collection of natural hair 102' located beneath or below the now connected base 12, as depicted in FIG. 8. As a result, the length and/or volume of the hair of the wearer 100 will then be defined by the blending or mixture of the supplemental strands 14 with the natural hair 102 dependent at least in part on the location of the hair extension assembly 10 relative to the natural hair 102 and scalp of the wearer 100. If desired, and if of sufficient length, portions of the second collection of natural hair 102" may subsequently overlay the base 12 and/or attachment assembly 18 to at least partially conceal same.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of attaching a hair extension assembly to the natural hair from the head of a wearer comprising:

positioning a base of the hair extension assembly and an attachment assembly connected thereto in adjacent, substantially aligned relation to a seam in the natural hair of the wearer, wherein a plurality of loops collectively extend along at least a portion of the length of the base of the hair extension assembly to at least partially define the attachment assembly, aligning the attachment assembly by disposing the plurality of loops along the length of the seam in a downwardly directed orientation relative to the length of the natural hair, maintaining a corresponding collection of extension hair above the seam prior to passage of a plurality of natural hair groupings through the plurality of loops, forming the plurality of natural hair groupings from a collection of natural hair disposed on a first side of the seam and collectively extending the plurality of natural hair groupings along a length of the seam, passing each of said plurality of natural hair groupings through at least some of the plurality of loops defining said attachment assembly, connecting each of said plurality of hair groupings to at least one next adjacent hair grouping subsequent to passage thereof through the attachment assembly, and positioning a collection of extension hair and the natural hair on a second side of the seam in overlying, covering relation to the seam.

2. A method as recited in claim 1 comprising passing adjacent ones of the plurality of natural hair groupings through correspondingly positioned, spaced apart ones of the plurality of loops of the attachment assembly.

3. A method as recited in claim 2 comprising securing a plurality of the natural hair groupings to one another subsequent to having passed through said plurality of loops using a wax based adhesive.

4. A method as recited in claim 1 comprising securing a plurality of at least two of the natural hair groupings to one another subsequent to passing through the plurality of loops.

5. A method as recited in claim 1 comprising removably securing the collection of extension hair above the seam prior to passage of the plurality of hair groupings through the plurality of loops.

6. A method as recited in claim 1 comprising removably securing the base and the attachment assembly in adjacent relation to the seam and adjusting the orientation of the attachment assembly to accomplish a preferred, aligned relation of the attachment with the seam.

7. A method as recited in claim 1 comprising forming the seam into a substantially horizontal, transverse orientation across at least a portion of the wearer's head and at least partially defining the substantially horizontal seam by a first collection of natural hair being located above the seam and a second collection of natural hair being located below the seam.

* * * * *